US009882316B2

(12) United States Patent
Chen et al.

(10) Patent No.: US 9,882,316 B2
(45) Date of Patent: Jan. 30, 2018

(54) ELECTRCIAL CONNECTOR AND MANUFACTURING METHOD OF THE SAME

(71) Applicant: FOXCONN INTERCONNECT TECHNOLOGY LIMITED, Grand Cayman (KY)

(72) Inventors: Chao-Chieh Chen, New Taipei (TW); Chih-Pi Cheng, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/263,345

(22) Filed: Sep. 12, 2016

(65) Prior Publication Data

US 2017/0077652 A1 Mar. 16, 2017

(30) Foreign Application Priority Data

Sep. 10, 2015 (CN) ..... 2015 1 0572916

(51) Int. Cl.
*H01R 13/58* (2006.01)
*H01R 13/648* (2006.01)
(Continued)

(52) U.S. Cl.
CPC ..... *H01R 13/6585* (2013.01); *H01R 13/405* (2013.01); *H01R 13/504* (2013.01);
(Continued)

(58) Field of Classification Search
CPC ..... H01R 13/6585; H01R 24/62; H01R 13/65802; H01R 13/6583; H01R 13/6582;
(Continued)

(56) References Cited

U.S. PATENT DOCUMENTS 8,851,927 B2 * 10/2014 Hsu ..... H01R 12/724 439/607.11
9,214,766 B1 * 12/2015 Yu ..... H01R 13/6585
(Continued)

FOREIGN PATENT DOCUMENTS

CN 203859275 U 10/2014
CN 203859329 U 10/2014
(Continued)

*Primary Examiner* — Xuong Chung Trans

(74) *Attorney, Agent, or Firm* — Wei Te Chung; Ming Chieh Chang

(57) ABSTRACT

An electrical connector includes a terminal module including an insulative housing, and upper contacts, lower contacts and a shielding plate embedded in the housing. The housing includes a base and a mating tongue extending from the base, the mating tongue defines an upper surface, a lower surface and a front face thereof. The upper and lower contacts includes contacting sections exposing to the upper and lower surfaces of the mating tongue and soldering sections out of the base and connecting section jointing the contacting sections and the soldering sections, respectively. The shielding plate is disposed between the upper and lower contacts and includes a pair of side latches. The housing includes an insulative sub-housing and an insulative coat, the whole upper surface and the whole front face of the mating tongue and part of the lower surface of the mating tongue are formed with the coat.

20 Claims, 12 Drawing Sheets

(51) Int. Cl.

| | |
|---|---|
| ***H01R 13/6585*** | (2011.01) |
| ***H01R 13/405*** | (2006.01) |
| ***H01R 13/504*** | (2006.01) |
| ***H01R 24/60*** | (2011.01) |
| ***H01R 43/24*** | (2006.01) |
| *H01R 107/00* | (2006.01) |

(52) U.S. Cl.
CPC ..... *H01R 24/60* (2013.01); *H01R 43/24* (2013.01); *H01R 2107/00* (2013.01)

(58) Field of Classification Search
CPC . H01R 24/60; H01R 13/6593; H01R 13/6581
See application file for complete search history.

(56) References Cited

U.S. PATENT DOCUMENTS

| | | | | |
|---|---|---|---|---|
| 9,318,856 | B2 * | 4/2016 | MacDougall ..... | H01R 13/6581 |
| 9,350,121 | B2 * | 5/2016 | Ju ..... | H01R 13/6585 |
| 9,496,664 | B2 * | 11/2016 | Little ..... | H01R 13/6587 |
| 9,502,827 | B2 * | 11/2016 | Feng ..... | H01R 13/6581 |
| 9,525,241 | B1 * | 12/2016 | Su ..... | H01R 13/6581 |
| 9,564,716 | B2 * | 2/2017 | Kao ..... | H01R 13/6586 |

FOREIGN PATENT DOCUMENTS

| | | | |
|---|---|---|---|
| CN | 204103121 | U | 1/2015 |
| CN | 104466592 | A | 3/2015 |
| CN | 104868272 | A | 8/2015 |
| CN | 104868321 | A | 8/2015 |
| CN | 204633040 | U | 9/2015 |

* cited by examiner

ELECTRCIAL CONNECTOR AND MANUFACTURING METHOD OF THE SAME

BACKGROUND OF THE INVENTION

1. Field of the Invention

The present invention generally relates to an electrical connector which is formed via two inserting-mold processes.

2. Description of the Related Art

USB 3.0 Promoter Group issues a new specification which establishes a new type connector named as USB Type-C Cable and Connector, on Aug. 11, 2014. In the specification, the Type-C plug enhances ease of use by being plug-able in either upside-up or upside-down directions. The receptacle connector has more elements and has smaller, thinner size. Hence, an improved electrical connector is desired, especially to mass product.

CN Patent Issued No. 203859275U discloses an electrical connector which includes an upper terminal module, a lower terminal module and a shielding plate sandwiched between the two terminal modules. The laminated assembly of the three elements will be damaged after thousands of insertion of a plug connector.

CN Patent Issued No. 203859329U discloses an electrical connector which includes an upper terminal module and a lower module embedded with a row of lower contacts and a shielding plate. The lower module defines terminal grooves on a top surface thereof to accommodate with front contacting sections of the upper terminals. Alternatively, the upper contacts can be firstly and separately disposed in the terminal grooves of the top surface of the lower module and then the upper insulator is covered on the upper contacts and the top surface via an insert-molding process molded. It's understandingly, the terminal grooves are manufactured using extra tool and a positioning method or tool is needed when the upper contacting section are assembled into the terminal grooves. Furthermore, the front ends of the upper contacts will raise after thousands of insertion of a plug connector.

In view of the above, an improved electrical connector is desired to overcome the problems mentioned above.

BRIEF SUMMARY OF THE INVENTION

Therefore, an object of the present invention is to provide an electrical connector with a new manufacture method.

To fulfill the above-mentioned object, an electrical connector comprises a terminal module comprising an insulative housing, and a row of upper contacts, a row of lower contacts and a shielding plate embedded in the insulating housing. The insulating housing comprises a base and a mating tongue extending from the base, the mating tongue defines an upper surface, a lower surface and a front face thereof. The upper and lower contacts comprises contacting sections exposing to the upper and lower surfaces of the mating tongue and soldering sections out of the base and connecting section jointing the contacting sections and the soldering sections, respectively. The shielding plate is disposed between the upper and lower contacts and comprises a pair of side latches. The insulative housing comprises an insulative sub-housing and an insulative coat, the whole upper surface and the whole front face of the mating tongue and part of the lower surface of the mating tongue are formed with the insulative coat.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
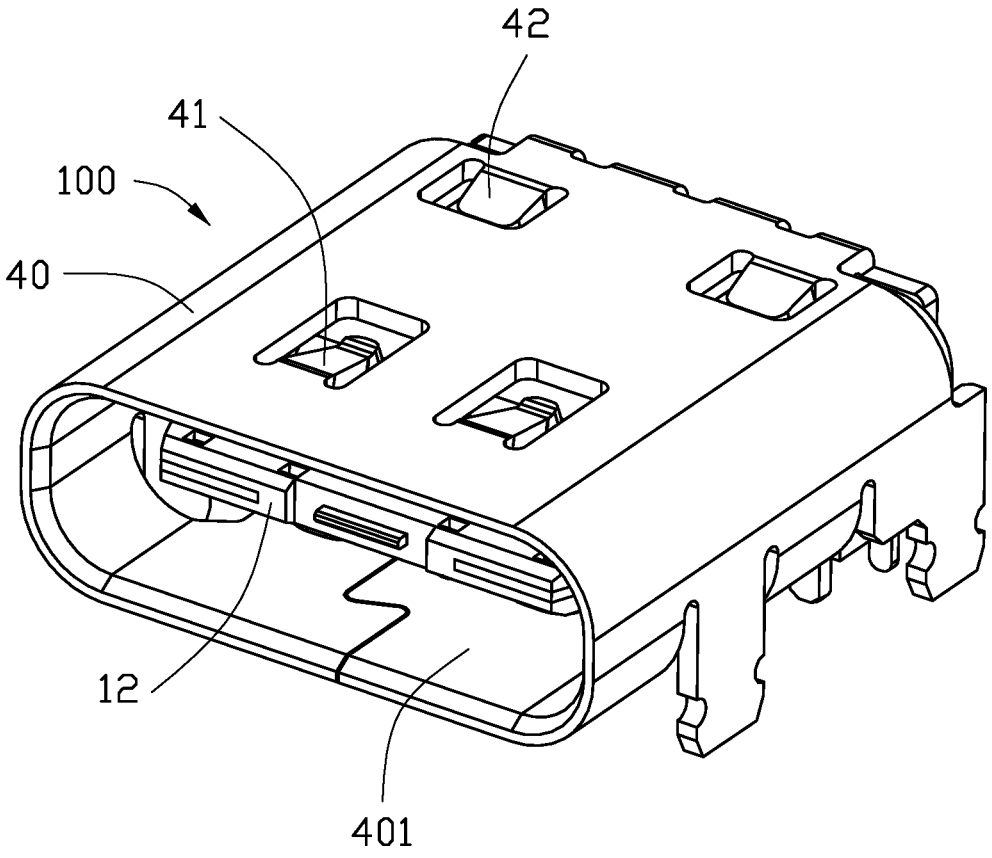
FIG. 1 is a top and front perspective view of an electrical connector made in accordance with the present invention.

Reference will now be made in detail to the preferred embodiment of the present invention.

Please referring to FIGS. 1 to 6, an electrical connector 100 of this preferred embodiment is a USB Type C receptacle intended to be mounted on a printed circuit board (PCB, not shown), which is inserted with a corresponding plug connector (not shown), in either of two insertion orientations. The electrical connector 100 comprises a metallic shell 40 defining a mating cavity 401, and a terminal module 10 retained in the metallic shell 40. The terminal module 10 comprises an insulative housing 11, two rows of contacts 21, 22 and a shielding plate 30 embedded in the insulative housing 11 via two insert-molding processes. The insulative housing 11 comprises a rear base 12 and a front mating tongue 13 integrally extending from the rear base 12. The mating tongue 13 extends into the mating cavity 401. The contacts comprises contacting sections 211, 221, soldering sections 213, 223 and a connecting sections 212, 222 connecting with the contacting sections and the soldering sections respectively. The contacts are divided into two rows, a row of first or upper contacts 21 and a row of second or lower contacts 22. The upper and lower contacting sections expose to corresponding upper surface 1301 and lower surface 1302 of the mating tongue 13. The shielding plate 30 is disposed between the upper and lower contacts and defines two side latches 31 beyond corresponding lateral sides of the mating tongue 13. The two outermost contacts, i. e, grounding contacts 21G of the upper contacts 21 define side wings 214 to touch with corresponding side wings 32 extending laterally and outwardly from the shielding plate 30. The lower contacts 22 also have two outermost grounding contacts mechanically connecting with the side wings 32 of the shielding plate 30. A pair of soldering leg 33 extends from a rear edge of the shielding plate 30. The metallic shell 40 is retained on the rear base 12 and surrounds the mating tongue 13 to define said mating cavity 401 between the mating tongue 13 and the shielding shell 40. In this embodiment, the metallic shell 40 defines spring arms 41 extending slantwise into the mating cavity 401 and stopping tabs 42 pressing against the recesses 12 defined on the top surface of the base 12. The stop tabs 42 extend forwardly and inwardly.

Figure 3:
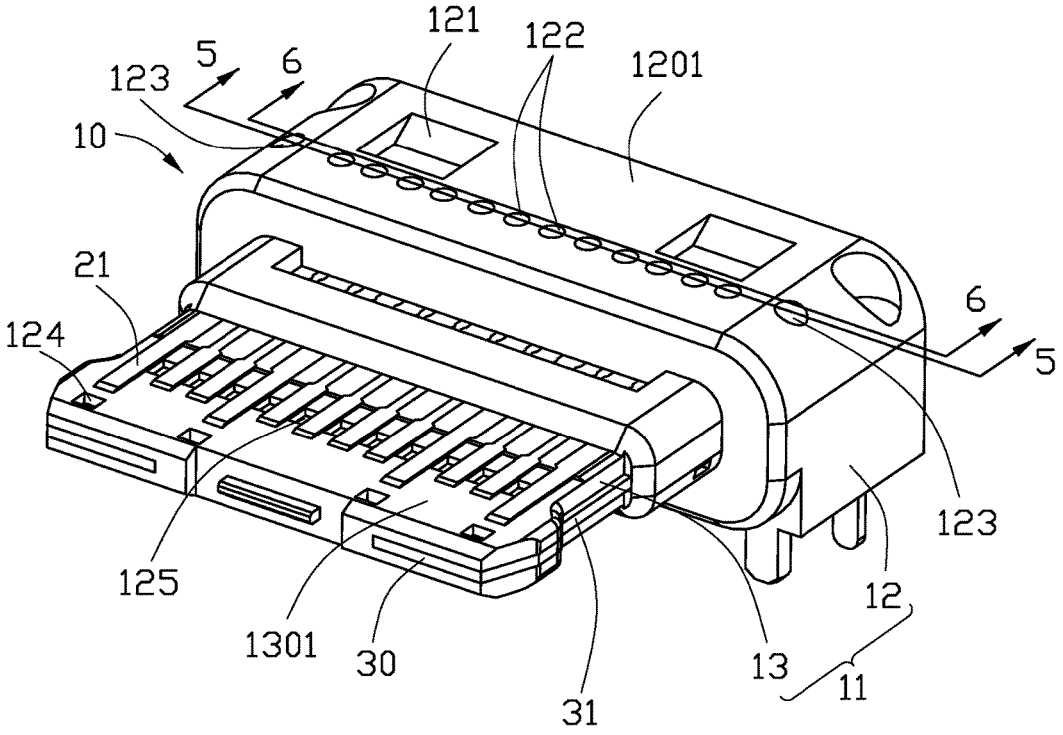
FIG. 3 is a top and front perspective view of terminal module of the electrical connector shown in FIG. 1.
Figure 4:
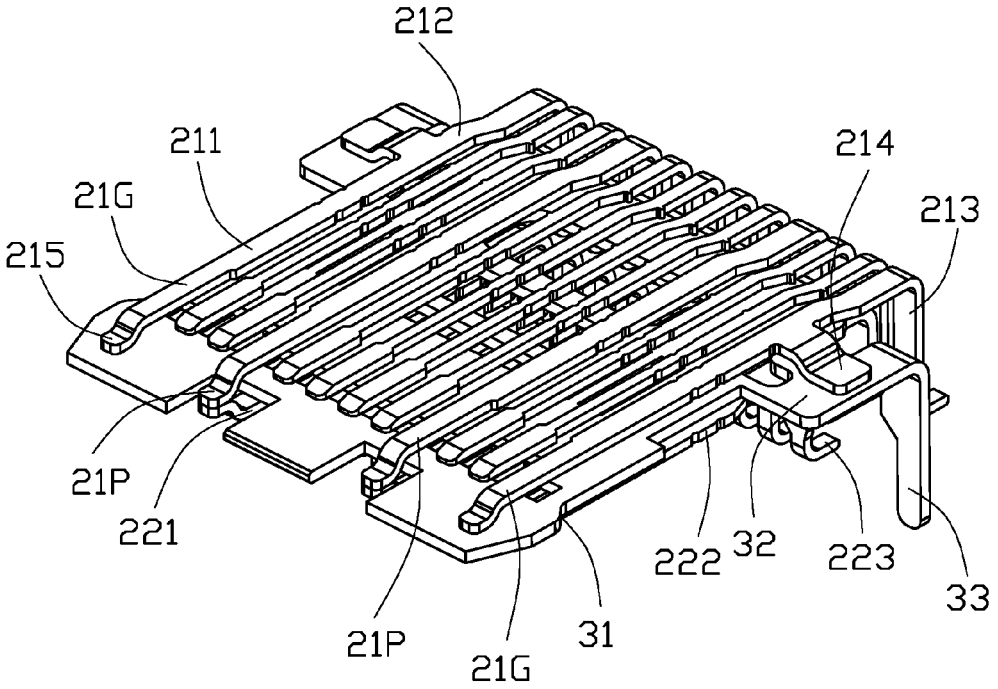
FIG. 4 is a perspective view of the upper and lower contacts, and the shielding plate.
Figure 5:
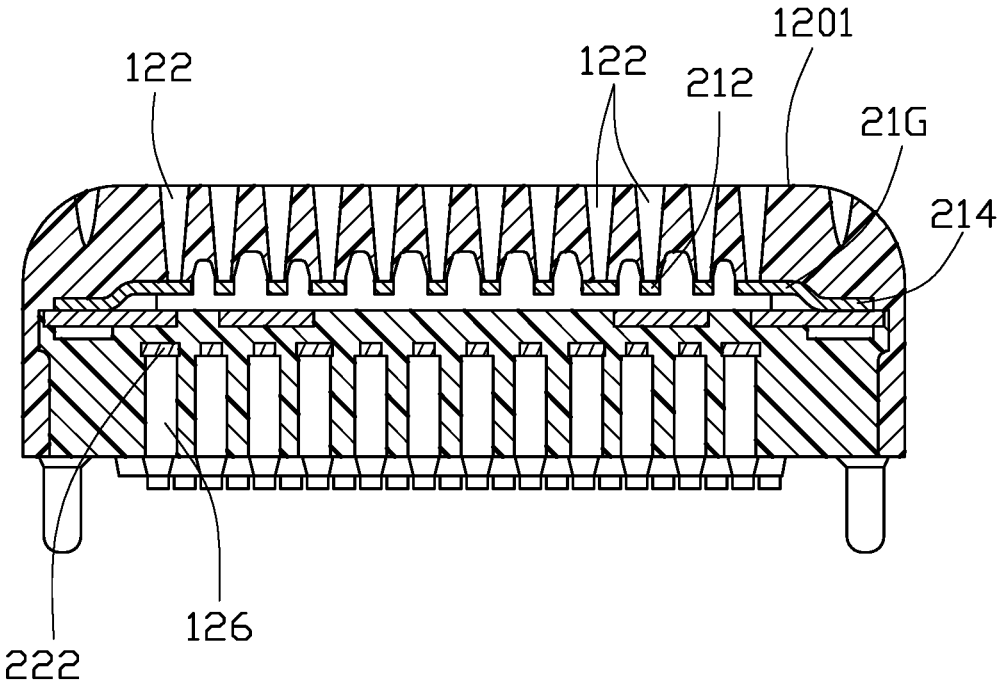
FIG. 5 is a cross-sectional view of the electrical connector along lines 5-5.
Figure 6:
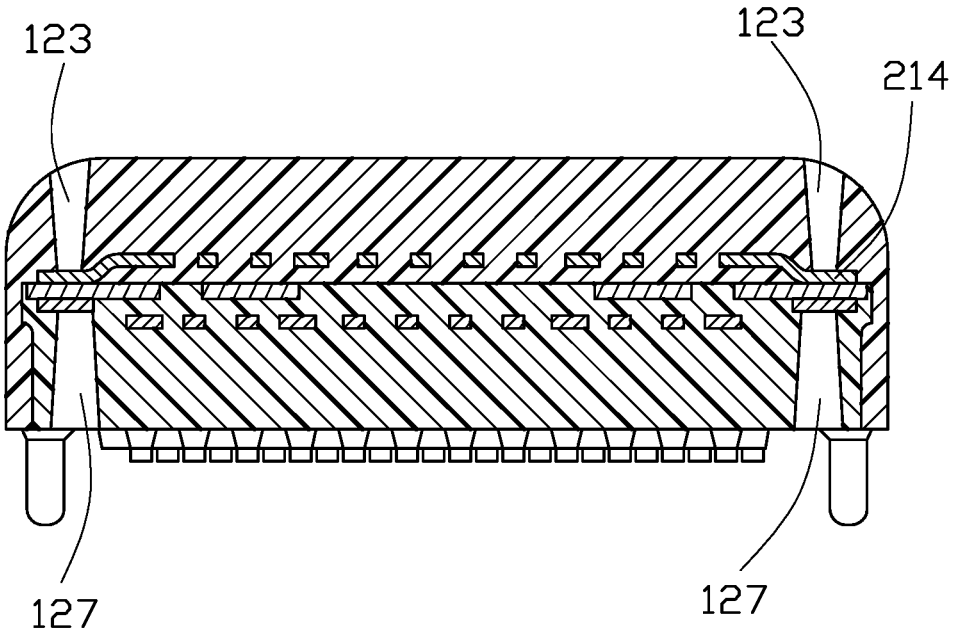
FIG. 6 is a cross-sectional view of the electrical connector along lines 6-6.
Figure 7:
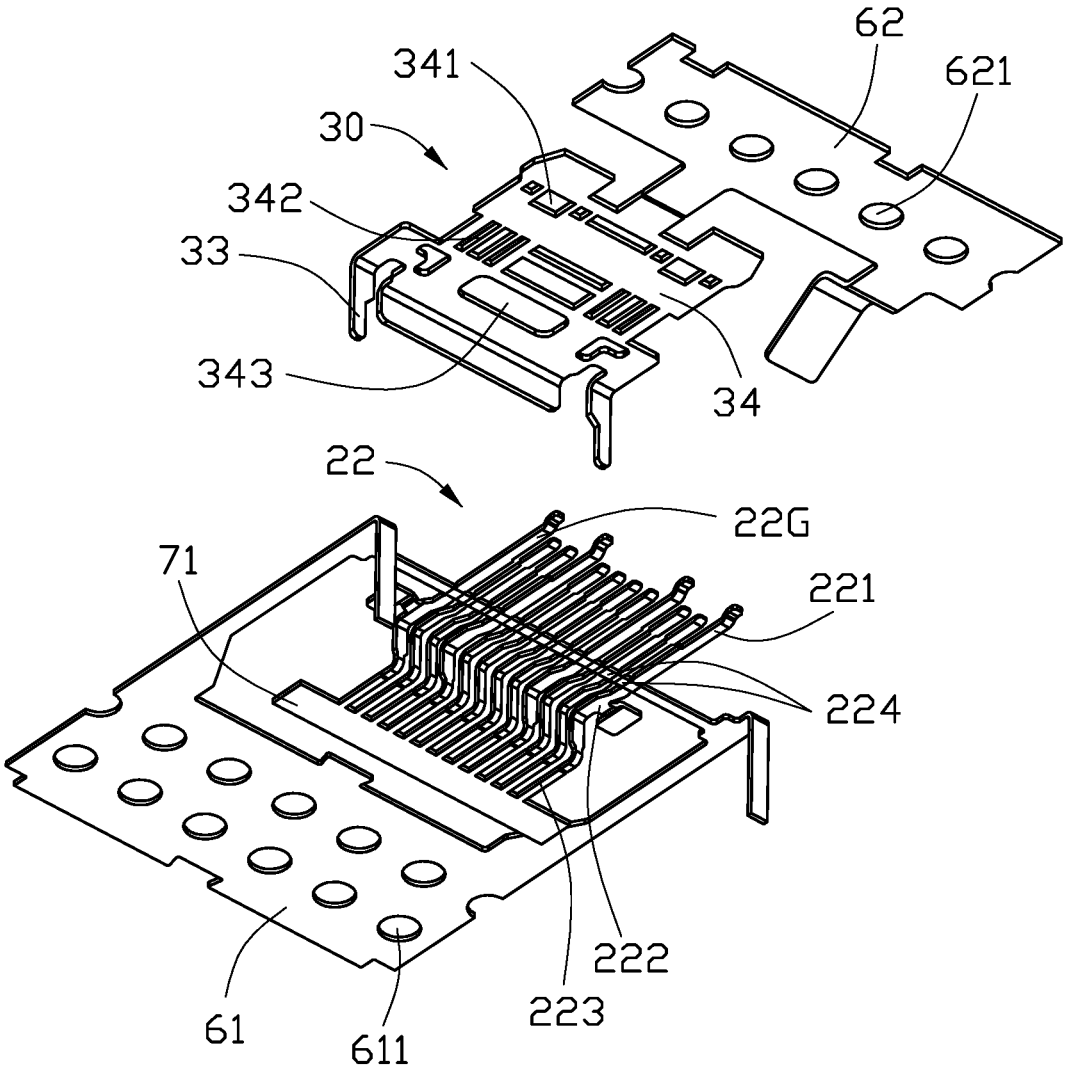
FIG. 7 is a first manufacturing step of the electrical connector wherein the shielding plate and the lower contacts are provided.

The terminal module 11 is produced via two insert-molding process. Referring to FIGS. 3, 5 and 6, the insulating housing 11 remains a row of first upper holes 122 which extend from the upper surface 1201 of the housing to the first contacts 21. In the preferred embodiment, the first upper holes 122 from the upper face 1201 of the rear base 12 are aligned with corresponding connecting section 212 of the first contacts 21, respectively. The housing 11 also remains two second upper holes 123, which extend from the upper face 1201 to the side wings 214 of the first contacts 21 and are aligned with corresponding side wings 214, respectively. The first contacts 21 comprise four longer contacts than other contacts, which are two grounding contacts 21G and two power contacts 21P. The front ends 215 of the longer contacts protrude forwardly compared with the other contacts. The housing 11 remains further third upper holes 124, which extend from the upper face 1201 to the front ends 215 and are aligned with corresponding front ends 215, respectively. The housing remains fourth upper holes 125 between every adjacent contacting sections 221.

The insulating housing 11 also remains a row of first lower holes 126 from the lower face and aligned with the connecting sections of the second contacts 22, second lower holes 127 aligned with the side wings. Third lower holes 128 and fourth lower holes 129. The arrangements of lower holes are similar to the upper holes, so specific description is omitted. Those holes are formed after the molds are removed.

The manufacture method the connector 100 will be described hereinafter as shown in FIGS. 7-11 with four main steps.

Step 1, the row of second/lower contacts 22 and the shielding plate 30 are provided and displaced at a predetermined position. The second contacts 22 comprise the contacting sections 221, the connecting sections 222 and the soldering sections 223 bending from the connecting sections, the adjacent connecting sections 222 are laterally connecting by a slim strip 224 and the two outermost second contacts 21 are connecting with a first carry strip 61 with positioning holes 611. The soldering sections 223 are connecting with a metal strip 71. The shielding plate 30 includes a main plate 34 and soldering legs 33 bending downwards from a rear edge of the main plate 34, a second carry strip 62 with positioning holes 621 is connected to the front edge of the shielding plate 30. The row of second contacts 21 and the shielding plate 30 are moved to a predetermined position through the two carry strips 61, 612 in automation process, wherein the row of second contacts 21 is located under the shielding plate 30.

Figure 8:
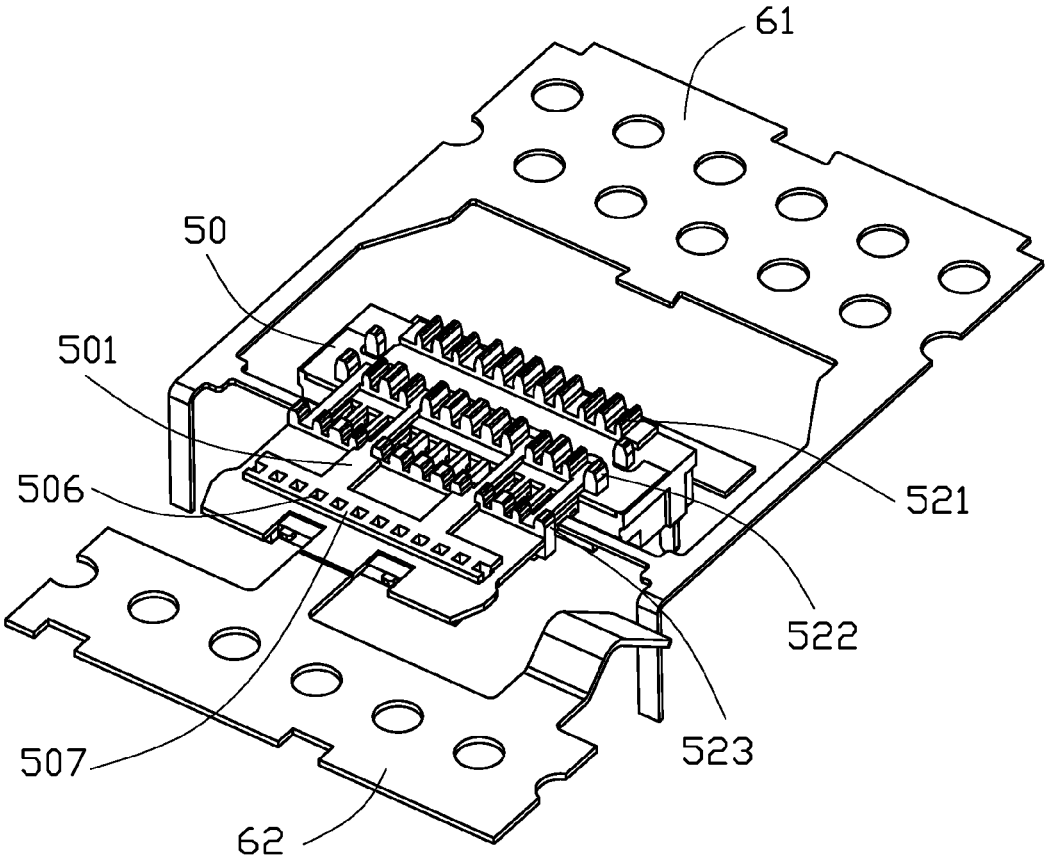
FIG. 8 is a second manufacturing step of the electrical connector wherein a first insert-molding process is applied.

Step 2, forming an insulative sub-housing 50 with the second contacts 22 and the shielding plate 30 embedded therewithin via a first inserting-molded process as shown in FIG. 8. The sub-housing 50 including a sub-base 504 and a sub-tongue 505, defines an upper surface 501 and a lower surface 502, the contacting section 222 of the lower contacts 22 expose to the lower surface of the sub-tongue of the sub-housing 50 and the soldering sections 223 extend out of the sub-base of the sub-housing 50. The main plate 34 of the shielding plate 30 is embedded in the sub-housing 50 and the soldering legs 33 extend out of the sub-housing 50. The sub-housing 50 remains a row of positioning holes 506 aligned with contacting sections of the lower contacts, which are formed by withdrawing the molds pressing against the contacting sections of the lower contacts in a vertical direction during the first inserting molded process. In the sub-mating tongue 505, the top surface 501 are in a double T shape and protrudes upwards from the shielding plat, so that it is formed as a projecting area 507, and the positioning holes 506 are formed along the projecting area 507

During the first insert-molding process, the slim trips 22 between every adjacent second contacts 21 avoid a shift movement infected by the flow of insulative material. The rear portions of the second contacts 22 are fitly pressed by a mold tool and the sub-housing 50 remains the first lower holes 126 after the sub-housing 50 is cooled and the mold tool is taken away. The side wings of the grounding contacts 22G is fitly pressed by a mold tool and the sub-housing 50 remains the second lower holes 127. The front ends of the grounding contacts are fitly pressed by a mold tool and the sub-housing 50 remains the third lower holes 128 after the mold is taken away. A mold is disposed between every two contacting sections 222 to position the contacting sections along a left and right direction and the sub-housing remains the fourth lower holes 129. The flow of the insulative material is poured from the shielding plate 30 and through holes 341, 342, 342 defined in a front, middle, rear rows of the shielding plate 30. The front holes 341 are aligned with the fourth lower holes 129, the middle holes 342 are aligned with the slim strip 224. A pre-process also can be used before the first inserting mold process, the lower contacts can be retained in an insulating blocking by a pre-inserting mold process, especially in a condition that first carry strip 61 has no slim strip 224.

The sub-housing 50 defines three rows of ribs 521, 522, 523, each row of the ribs is aligned with the lower holes. The sub-housing 50 includes a sub-base 504 and a sub-tongue 505, the contacting sections 222 are embedded in the sub-tongue 505 and only expose its contacting surface to the sub-tongue 505. The middle ribs 522 and the rear ribs 523 are located on the sub-base 504, the front ribs 523 are located on the sub-tongue 504.

Figure 9:
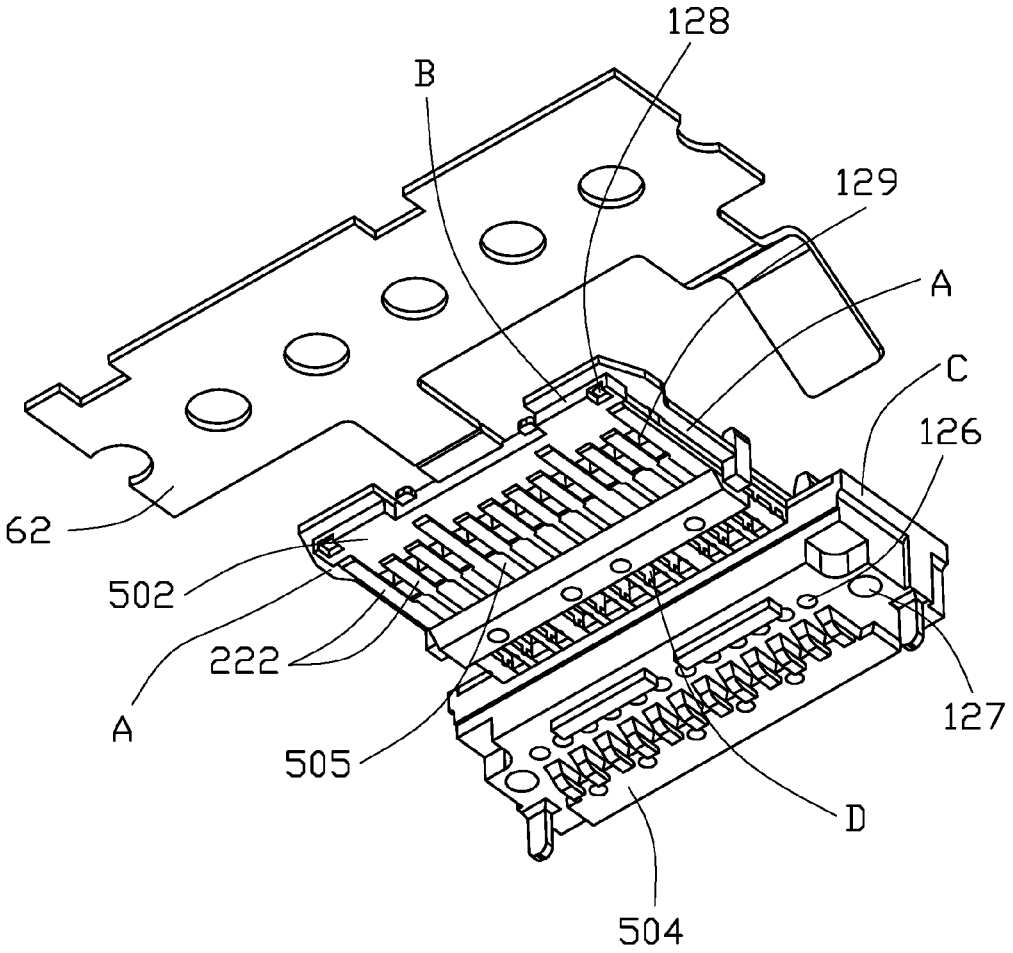
FIG. 9 is an another perspective view of the connector in FIG. 8.
Figure 10:
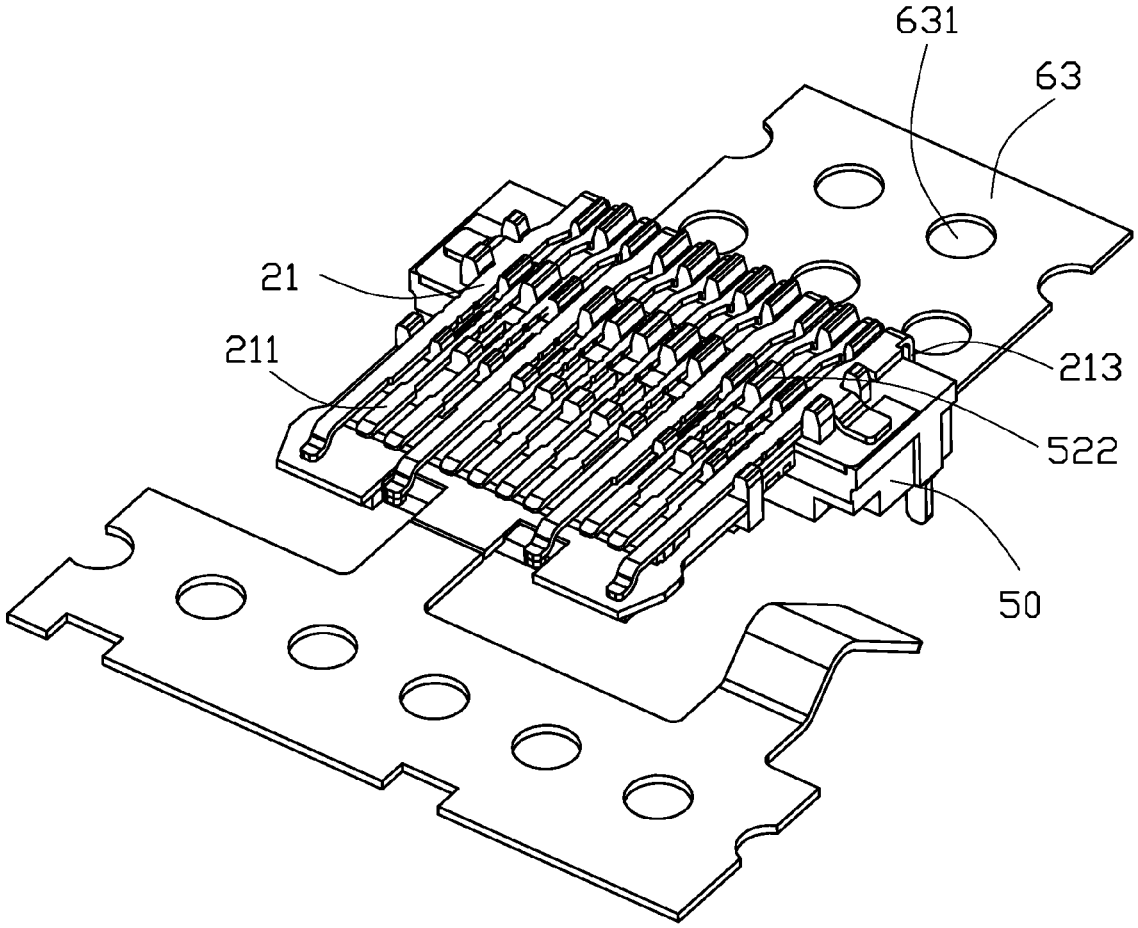
FIG. 10 is a third manufacturing step of the electrical connector wherein the upper contacts are disposed on the sub-assembly of the electrical connector.
Figure 11:
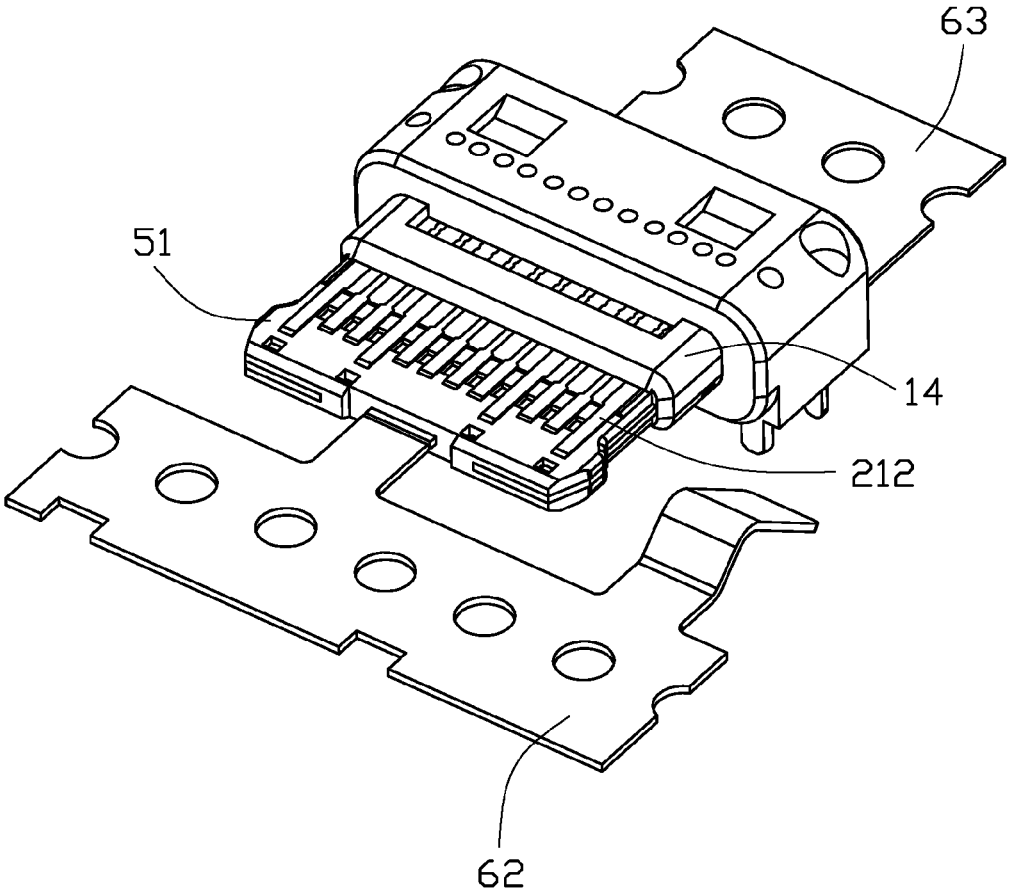
FIG. 11 is a fourth manufacturing step of the electrical connector wherein a second insert-molding process is applied.

A successive step 11 after the step 1 as shown in FIG. 9, the first carry strip 61 connecting with the lower contacts 22 is cut away from the second contacts 22 and the slim strip 224 are cut away. The strip 71 is also cut away from the soldering sections 223 of the second contacts. The second carry strip 62 is remained in front of the sub-housing 50 for automotive moving.

Step 3, positioning the row of first or upper contacts 21 on the top face 501 of the sub-housing 50. The upper contacts 21 comprises contacting sections 211, soldering sections 213 and connecting section 212 joining the contacting sections 211 and the soldering sections 213 together, respectively. A third carry strip 63 with positioning holes 631 is connecting with the rear ends of the soldering sections 213. The row of first contacts 21 is moved to the sub-housing 50 and disposed on the upper face 501 of the sub-housing 50 via the third carry strip 63. The connecting sections 213 are limited between the ribs 521, 522, 523 for positioning The contacting sections 213 are covering on the positioning holes 506.

Figure 2:
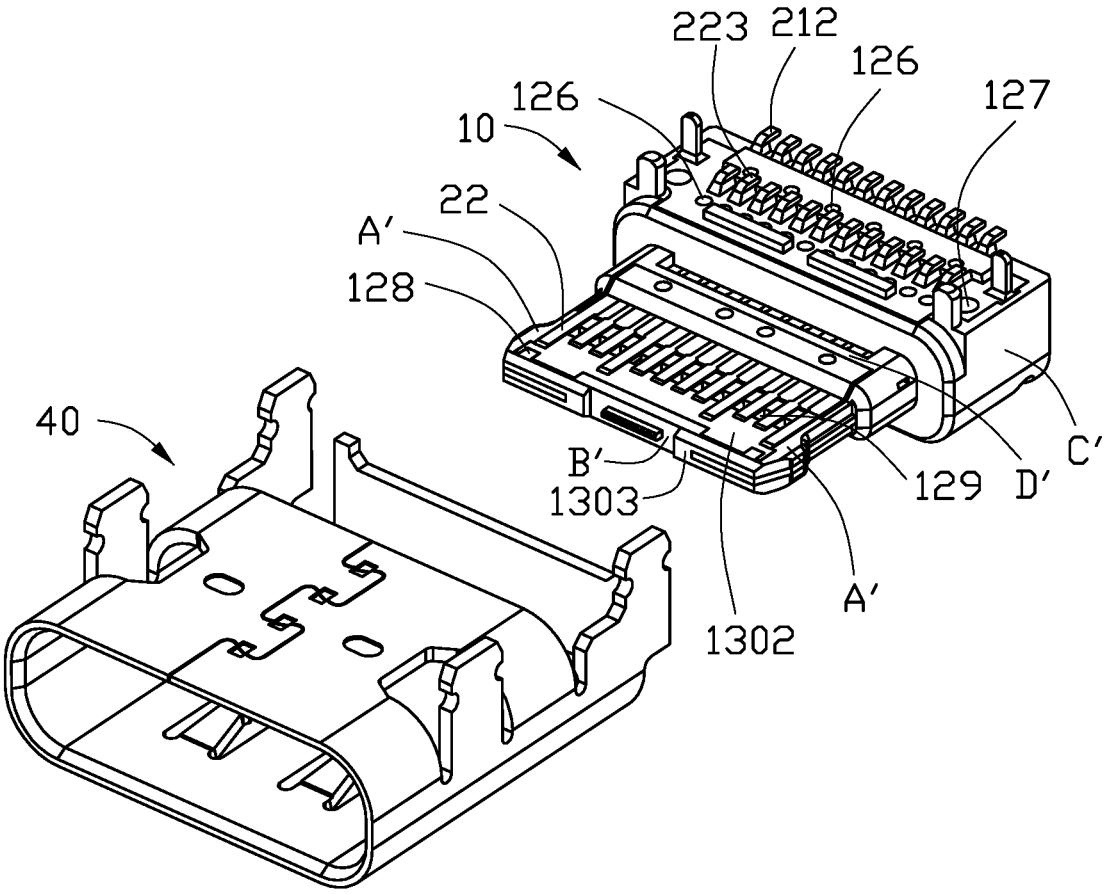
FIG. 2 is a bottom and front exploded perspective view of the electrical connector in FIG. 1.
Figure 12:
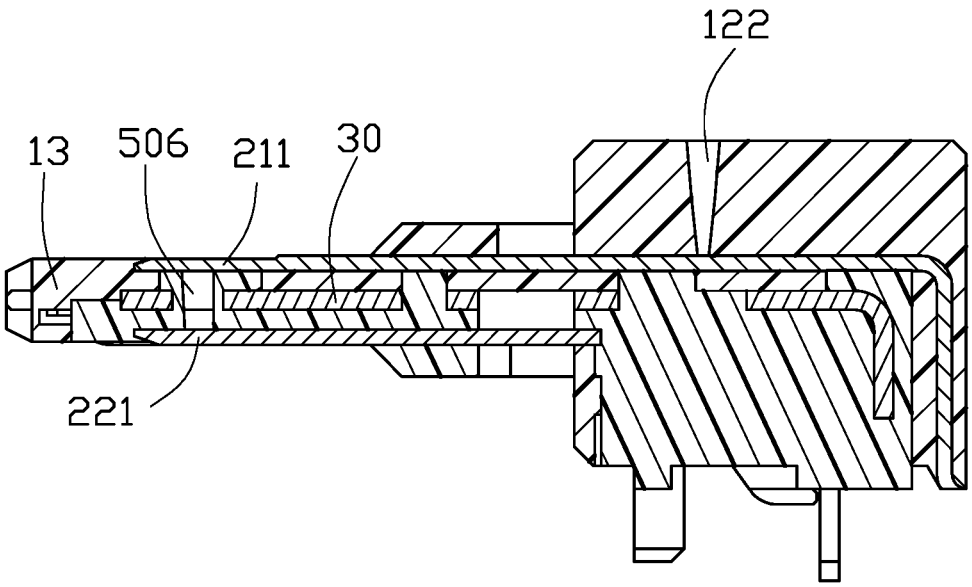
FIG. 12 is a cross sectional view of the terminal module of the electrical connector along the contacts in the front and rear direction.

Step 4, forming an insulative coat 51 embedded with the upper contacts 21 and the sub-housing 50 via a second insert-molding process. The contacting sections 511 exposes to the insulative coat 51 and the shielding plate 30 is under the insulative coat 51. During the second inserting mold process, the lower face 502 of the sub-housing 50 is also filled with insulative coat 51. Therefore, a complete terminal module 10 is formed. The positioning holes 505 are remained since the insulating material is blocked by the contacting sections 211 of the upper contacts 21 as shown in FIG. 12. If the positioning holes 506 are not wholly covered by the contacting sections 211, the insulating material can fill into the positioning holes 506. The terminal module 10 comprises the base 12 and the mating tongue 13 extending from the base, the mating tongue 12 is enlarged and widen at a root near the base to form a step portion 14. Alternatively, a pair of collar surrounding the step portion 14 can be provided. During the second insert-molding process, the insulative coat 51 is melted to integrate with the insulative sub-housing 50. If the sub-housing 50 and the coat 51 use with different colours, a border line will be clearly seen. As shown in FIG. 2 and FIG. 9, the two sides A, the front edge B and the rear portion D of the sub-tongue 505, and the sides of the sub-base 504 are empted as shown in FIG. 9 and then filled with the insulative coat 51 as shown in FIG. 2. That is, the two sides A' and the front edge B' and the step portion D' of the mating tongue 13 and the sides C' of the base 12 are part of the insulative coat. The whole upper surface 1301 and the whole front face 1303 and part of the lower surface of the mating tongue 13 are completed with the insulative coat 51 and the lower surface 1302 are completed with the sub-tongue 505 of the sub-housing 50 and the insulative coat 51. The coat 51 also covers the sub-base 504 of the sub-housing 50 and the soldering sections 513 are embedded in the coat 51

A successive step 41 after the step 4, the third carry strip 63 is taken away from the first contacts 21 and the second carry strip 62 is taken away from the shielding plate 30.

Step 5, the shielding shell 40 is provided to assemble on the insulative housing. Selectively, the second carry strip 62 can be cut after the shielding shell 40 is assembled.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a terminal module comprising an insulative housing, and a row of upper contacts, a row of lower contacts and a shielding plate embedded in the insulating housing;

the insulating housing comprising a base and a mating tongue extending from the base, the mating tongue defines an upper surface, a lower surface and a front face thereof;

the upper and lower contacts comprising contacting sections exposing to the upper and lower surfaces of the mating tongue and soldering sections out of the base, and connecting sections jointing the contacting sections and the soldering sections, respectively;

the shielding plate disposed between the upper and lower contacts and comprising a pair of side latches;

wherein the insulative housing comprises an insulative sub-housing and an insulative coat, the whole upper surface and the whole front face of the mating tongue and part of the lower surface of the mating tongue are formed with the insulative coat;

wherein the insulative coat defines a plurality of openings between the contacting sections of every adjacent upper contacts.

2. The electrical connector as claimed in claim 1, wherein the lower contacts and the shielding plate are embedded in the insulative sub-housing while the upper contacts and the sub-housing are partly embedded in the insulative coat.

3. The electrical connector as claimed in claim 1, wherein the insulative housing remains a row of first upper holes, the first upper holes are aligned with the connecting sections of the upper contacts and extend from an upper face of the base to the connecting sections.

4. The electrical connector as claimed in claim 3, wherein two outermost contacts of the upper contacts define side wings laterally extending therefrom and contact with the shielding plate.

5. The electrical connector as claimed in claim 4, wherein the insulative housing remains two second upper holes, the second upper holes are aligned with the side wings of the shielding plate and extend from an upper face of the base to the side wings respectively.

6. A manufacturing method of an electrical connector comprising:

step 1: holding a row of second contacts and a shielding plate in a pre-position, the second contacts comprise contacting sections;

step 2: forming an insulative sub-housing on the second contacts and the shielding plate via a first insert-molding process, wherein the sub-housing comprises an upper face and a lower face, the contacting sections of the second contacts expose to the lower face, the sub-housing defines a projecting are on a front of the upper face and a plurality of ribs on a middle of the upper face;

step 3: disposed a row of first contacts on the upper face of the sub-housing, the first contacts comprises contacting sections, soldering sections and connecting sections jointing the contacting sections and the soldering sections, wherein the contacting sections are supported on a top of the projecting area and the connecting sections are positioned between ribs to limit the connecting sections in a left and right direction;

step 4: forming an insulative coat on the first contacts and the sub-housing via a second insert-molding process, wherein the insulative coat completes the lower face of the sub-housing, contacting sections of the first contacts exposes to an upper face of the insulative coat and the shielding plate are located between the first contacts and the second contacts, therefore forming a terminal module which comprising a base and a mating tongue extending from the base.

7. The manufacturing method as claimed in claim 6, wherein the second contacts comprises the contacting sections, soldering sections and connecting sections jointing the contacting sections and the soldering sections respectively, the soldering sections extend from the lower face of the sub-housing and the contacting sections and the connecting sections are embedded in the sub-housing in the step 2 of the manufacturing method, the shielding plate comprises a main plate embedded in the sub-housing and a soldering leg extending from a rear edge of the main plate and out of the sub-housing in the step 2 of the manufacturing method.

8. An electrical connector comprising:

a terminal module including an insulative housing, and a row of first contacts, a row of second contacts and a shielding plate located embedded in the insulating housing;

the insulating housing including a base and a mating tongue forwardly extending from the base in a front-to-back direction, the mating tongue defines an first surface and a second surface opposite to each other in a vertical direction perpendicular to said front-to-back direction;

each of the first contacts including a first contacting section exposing upon the first surface;

each of the second contacts including a second contacting section exposed upon the second surface, a second solder leg and a second connecting portion connecting with the second contacting section and the second solder leg;

the shielding plate disposed between the upper and lower contacts in the vertical direction, and including a pair of side latching edges in a transverse direction perpendicular to both said front-to-back direction and said vertical direction; wherein the insulative housing is formed with at least an insulative sub-housing and an insulative coat, and said sub-housing is integrally formed with the second contacts and the shielding plate via an initial step insert-molding process while said coat is integrally formed with the first contacts via a successive step insert-molding process so as to have the first surface essentially fully formed by the coat while the second surface essentially fully formed by the sub-housing except along a peripheral region thereof;

wherein the sub-housing defines a projecting area and a plurality of front ribs thereof, the second contacting sections are supported on the projecting area and the second connecting sections are positioned and limited between adjacent front ribs in a left and right direction.

9. The electrical connector as claimed in claim 8, wherein a front portion of the mating tongue is essentially fully formed by the coat during the successive step insert-molding process.

10. The electrical connector as claimed in claim 8, wherein in the mating tongue the shielding plate forms a first face and a second face opposite to each other in the vertical direction, said first face facing the first contacting sections while said second face facing the second contacting sections in the vertical direction, said sub-housing including a first part applied upon a small portion of the first face to support the first contacts during the successive step insert-molding process, and a second part applied upon a large portion of the second face to hold the second contacts after the initial step insert-molding process.

11. The electrical connector as claimed in claim 10, wherein the sub-housing around said first part forms a plurality of through openings in aligned with the corresponding second contacts in the vertical direction to support the second contacts during the initial step insert-molding process.

12. The electrical connector as claimed in claim 8, wherein said peripheral region is applied by the coat.

13. The electrical connector as claimed in claim 12, wherein said peripheral region forms a U-shape in a top view taken along the vertical direction.

14. The electrical connector as claimed in claim 8, wherein said shielding plate forms a large notch in a front edge region to have front ends of the corresponding first contacting section and those of the second contacting sections electrically and mechanically connected to each other in the vertical direction and embedded within the housing.

15. The electrical connector as claimed in claim 8, wherein the sub-housing forms a plurality of openings in the second surface between the second contacting sections of every adjacent two second contacts to hold the second contacting sections during the initial step insert-molding process, and the coat forms a plurality of openings in the first surface between the first contacting sections of every adjacent first contacts to hold the first contacting sections during the successive step insert-molding process.

16. The electrical connector as claimed in claim 8, wherein front ends of all the first contacts are embedded within the coat while front ends of most second contacts are embedded within the sub-housing and those of remaining second contacts are embedded within the coat.

17. The electrical connector as claimed in claim 8, wherein the coat forms a plurality of openings in the first surface between the first contacting sections of every adjacent first contacts to hold the first contacting sections during the successive step insert-molding process.

18. The electrical connector as claimed in claim 8, wherein the sub-housing includes a sub-base and a sub-tongue, the front ribs are located at a root of sub-tongue to the sub-base.

19. The electrical connector as claimed in claim 18, wherein the sub-housing further includes a plurality of rear ribs located at the sub-base near to the second solder legs.

20. The electrical connector as claimed in claim 19, wherein the sub-housing further includes a plurality of middle ribs between the front ribs and the rear ribs and located at the sub-base.

* * * * *